United States Patent [19]

Heesch

[11] 4,173,845

[45] Nov. 13, 1979

[54] UNITARY REGULATOR MECHANISM FOR MULTIPLE WINDOW PANELS

[75] Inventor: Max O. Heesch, Brooklyn, Mich.

[73] Assignee: International Telephone and Telegraph Corporation, New York, N.Y.

[21] Appl. No.: 434,632

[22] Filed: Jan. 18, 1974

[51] Int. Cl.[2] ..... E05F 11/44

[52] U.S. Cl. ..... 49/350; 74/25; 74/435

[58] Field of Search ..... 74/435, 25; 49/48, 142, 49/144, 349, 350, 351

[56] References Cited

U.S. PATENT DOCUMENTS

| | | | |
|---|---|---|---|
| 2,359,580 | 10/1944 | Poole | 74/435 |
| 2,591,232 | 4/1952 | Brown | 49/350 |
| 2,658,791 | 11/1953 | Anderson | 49/48 |
| 3,788,005 | 1/1974 | Mistopoulos, Jr. | 49/351 |
| 3,816,962 | 6/1974 | Ladd et al. | 49/351 |

*Primary Examiner*—Kenneth Downey

*Attorney, Agent, or Firm*—James B. Raden; Marvin M. Chaban

[57] ABSTRACT

Disclosed is a regulator mechanism for two window panels mounted in the door of an automotive vehicle. The panels are slidable independently of one another in a common plane between raised and lowered positions under the control of the regulator mechanism. Both window panels are operated by independently operable lever arms, both lever arms being mounted for rotation on a common pivot shaft. The lever arms are secured to respective sector gears, both sector gears also being mounted for rotation on the common pivot shaft. Each sector gear is driven independently of the other by a driving gear, the driving gears being angularly spaced from the pivot shaft to prevent operative interference between the operative end of each lever arm. The mechanism is mounted as a unitary assembly on a unitary mounting plate, the plate providing a support structure for the common pivot shaft and the respective pinion shafts. In this manner, the spacing between the respective operating gears is set once the mechanism is assembled as a unit and need not be adjusted on assembly of the unit into the vehicle.

6 Claims, 7 Drawing Figures

UNITARY REGULATOR MECHANISM FOR MULTIPLE WINDOW PANELS

BACKGROUND OF THE INVENTION

In automotive usage, it is commonplace to mount two independently operable window panels within the same door structure, one being the main windowand the other a small vent window. The regulator mechanisms for each window panel in some cases are generally totally independent of one another and therefore require two separate, spaced-apart operating mechanisms, most frequently to provide one slide movement and one rotational movement.

In other forms, slidable window panels operable in sequence from a single common operator are known. The panels may thus be controlled from a common regulator mechanism.

Objection to such sequential controls was raised by customers based on the inflexible nature of the sequence. As a result, it is desired that a regulator mechanism be devised which allows movement of the two panels independently of one another under the selective control of the user.

SUMMARY OF THE INVENTION

In the industry for which usage is anticipated for the present invention, i.e., automotive, assembly time is extremely important and investigated thoroughly for possible reductions. Thus, any apparatus which can be assembled speedily and efficiently is of commercial value, the amount of time saved being one key to the degree of commercial value. Disclosed herein is an apparatus which can be readily mounted on the vehicle requiring a minimum of assembly line time. In addition, the unitary mechanism as shown is rugged, requires little to no adjustment and takes up a minimum of space on the door on which it is mounted.

The present invention provides two independently operable slidable window panels movable in a common plane controlled by a single regulator assembly responsive to two separate and distinct inputs.

The two independent window operators may be either manually driven by separate cranks as shown, or may be motor-driven with motor or motors rotating the crank gears (not shown).

To produce this unitary regulator assembly, I provide a common support member mountable onto the internal structural panel of the door, the common member bearing and supporting independently functioning operators receptive to the respective inputs. The operators each include a sector gear and a lever arm, the sector gears and lever arms all being mounted on and rotatable about a common pivot on said support member. In this way, I produce a unitary regulator mechanism capable of operating two slidable window panels independently. The mechanism is compact and easy to install as a single unit and takes up comparatively little space as mounted.

It is therefore an object of my invention to provide a unitary regulator mechanism which provides two independently operable window panel controls.

It is a further object of my invention to provide a unitary regulator mechanism for controlling the movement of two slidable window panels moving in parallel paths in a common plane wherein the window operators are mounted on a common support member and utilize a common pivot on that member.

It is a still further object of my invention to provide a common mechanism for opening and closing two window panels independently of one another, the mechanism providing independently driven sector gears, one for each window panel, the sector gears being mounted on and rotatable about a common axis or pivot shaft on a common mounting member.

It is a still further object of the invention to provide a unitary regulator mechanism for raising and lowering two windows independently, the mechanism including plural meshing gears all mounted on the same support member adapted for unitary mounting on the door.

Other objects, features and advantages of my invention will become apparent from the following description viewed in conjunction with the drawings, a brief description of which follows.

DETAILED DESCRIPTION OF THE DRAWINGS

Figure 6:
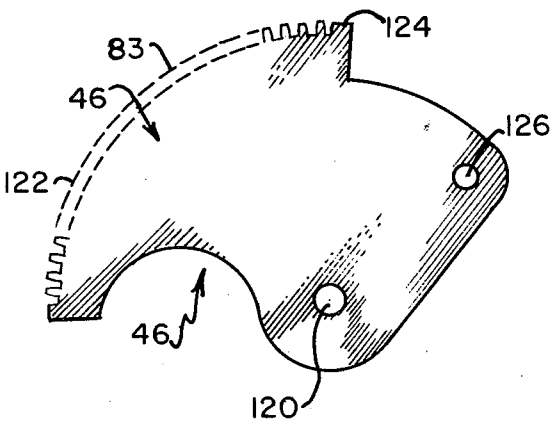
FIG. 6 is a side elevational view of the vent window sector gear of FIG. 1.
Figure 5:
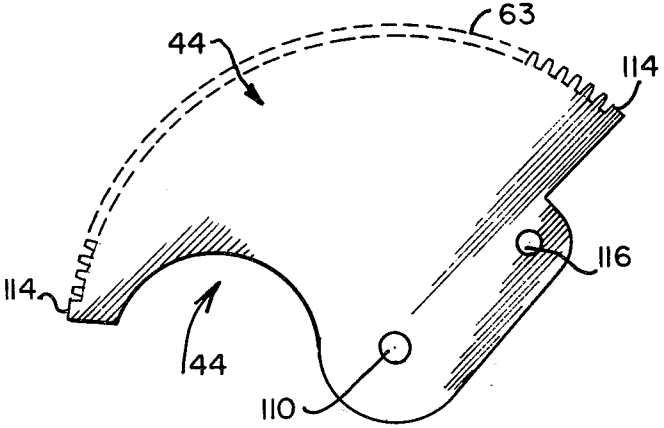
FIG. 5 is a side elevational view of the main window sector gear of FIG. 1.
Figure 7:
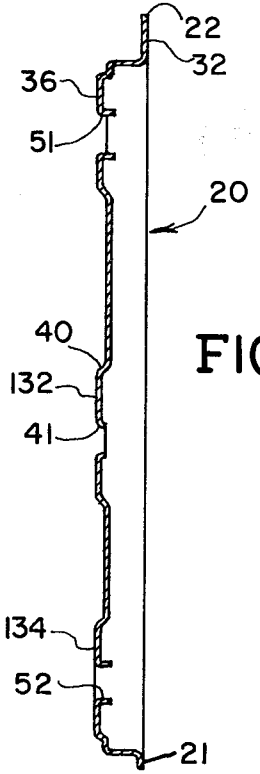
FIG. 7 is a sectional view of the mounting plate of the mechanism of FIG. 1, viewed along line 7—7 of FIG. 3.

In FIGS. 1–4, I show one embodiment of my regulator mechanism 12 as applied to the front door of an automobile, the door exterior panel having been cut away to show the interior thereof. (FIGS. 5–7 show details of the components of this embodiment).

A laterally extending sheet metal support panel 14 provides an internal, structural support member for the door, as is known, and provides a mounting surface for the mechanism 12 on its externally facing side. Suitable openings (not shown) are provided as necessary in support 14 to allow mounting of the mechanism permitting control of the regulator mechanism from the interior of the vehicle, as is well-known to move the window panels 16 (main window) and panel 18 (vent window).

When a vent window panel is used in a vehicle, it is usually placed forward of the main window panel, and may be controlled in a number of ways. In the older vehicles, a crank was used to rotate the vent window panel about a vertical pivot at one end of the vent window to provide a wind deflector with the vent in an open condition. Other vehicles used a pivotal vent window panel movable about a vertical pivot responsive to manual pressure on the panel itself. A more recent approach has been to employ a vent window panel slidable in a vertical plane of the door, the plane being that of the main sliding window panel or at least parallel to that plane. This approach of providing sliding vent and main window panels is especially of value where power controls for the window panels are utilized. In one form a single motor suitably clutched, can operate the operators of the regulator mechanism separately or in sequence. Clearly two motors could be used, one for each window panel. Manual crank controls for each window panel are equally acceptable in the manner shown herein.

In the embodiment shown, both window panels are mounted for essentially vertical slidable motion preferably in a common plane or in parallel planes only slightly offset from one another. With the window panels fully raised, a suitable sealing load must be developed within the regulator mechanism to hold both window panels in the fully raised and closed position. The window panels must travel a distance sufficient to recess the windows fully within the door below the provided sill level of the door frame. Naturally, the window panels must be capable of unencumbered movement and must be capable of remaining in a partially raised position, if such position is desired. Positively driven gear members are provided to produce the necessary sealing load, to provide the partially open maintenance force and to produce the desired travel pattern.

Figure 1:
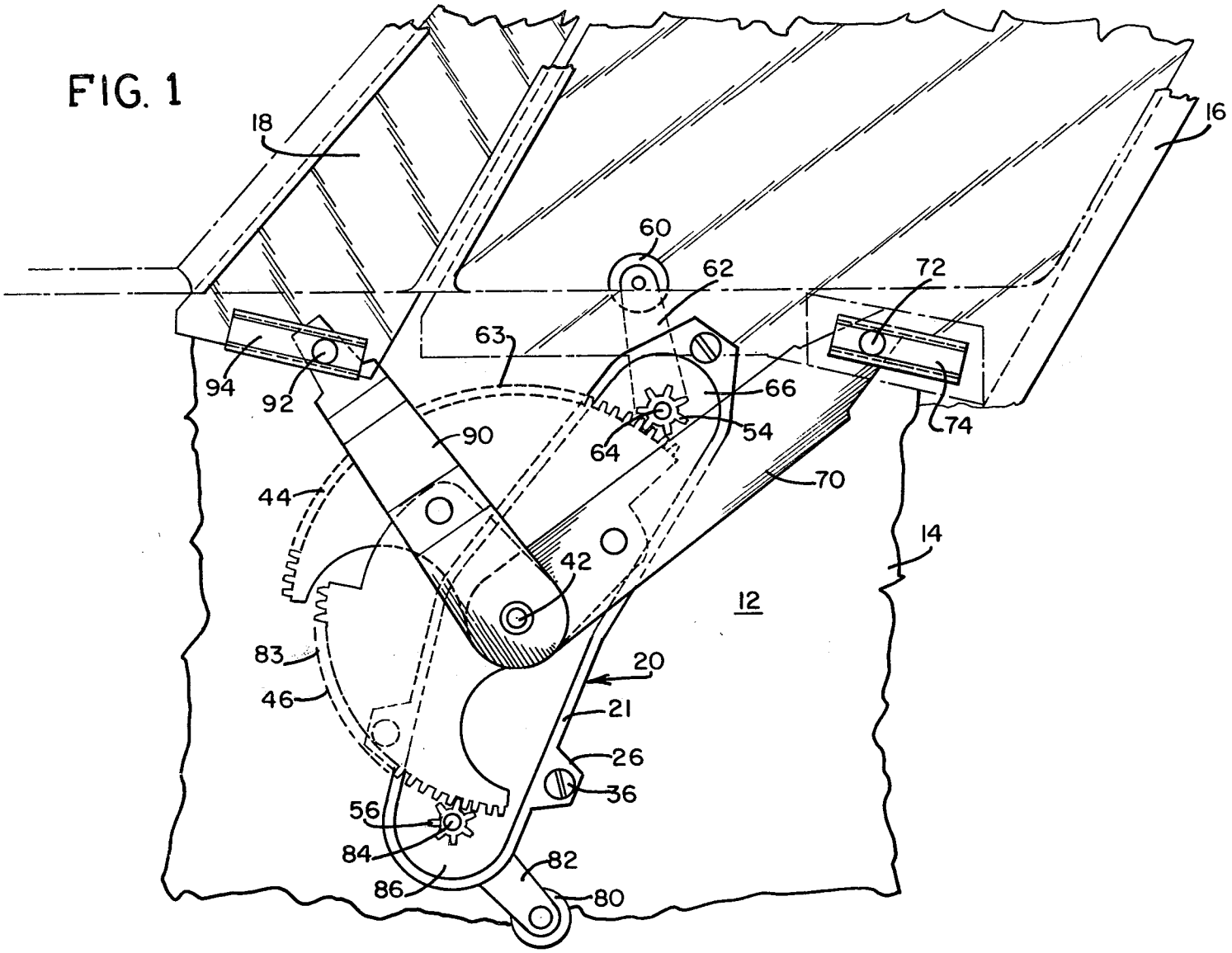
FIG. 1 is a side elevational view of the regulator mechanism using my invention as applied schematically to the windows of an automotive vehicle, the window panels being shown in the closed position.

In FIG. 1, I show a mounting plate 20 which is fabricated of suitable heavy gauge sheet metal for receiving and being the mechanism 12 in a unitary assembly. This plate 20 receives and supports the operative elements of the regulator mechanism allowing the mechanism to be mounted by affixing plate 20 to the exterior side of the internal door support panel 14. The plate 20 is drawn or otherwise formed to include a first or mounting plane including a rim portion 21 and mounting wings 22, 24 and 26 which are adapted to rest against the support surface and are secured thereto by suitable mounting screws within screw openings 32, 34 and 36. As can best be seen in FIG. 7, the central area of the mounting plate is formed with a raised central section 40, this section being used to provide a circular opening 41 for the central pivot shaft 42, the shaft supporting two sector gears, main window panel sector gear 44 and vent window panel sector gear 46, and also provides spaced apart openings 51 and 52 for the two pinion gears adapted to mesh with the sector gear, the pinion gears being main window panel pinion gear 54 and vent window panel pinion gear 56. The shaft 42 may have a suitable headed portion 58 to secure the shaft to the plate 20, allowing rotation of the shaft.

Figure 2:
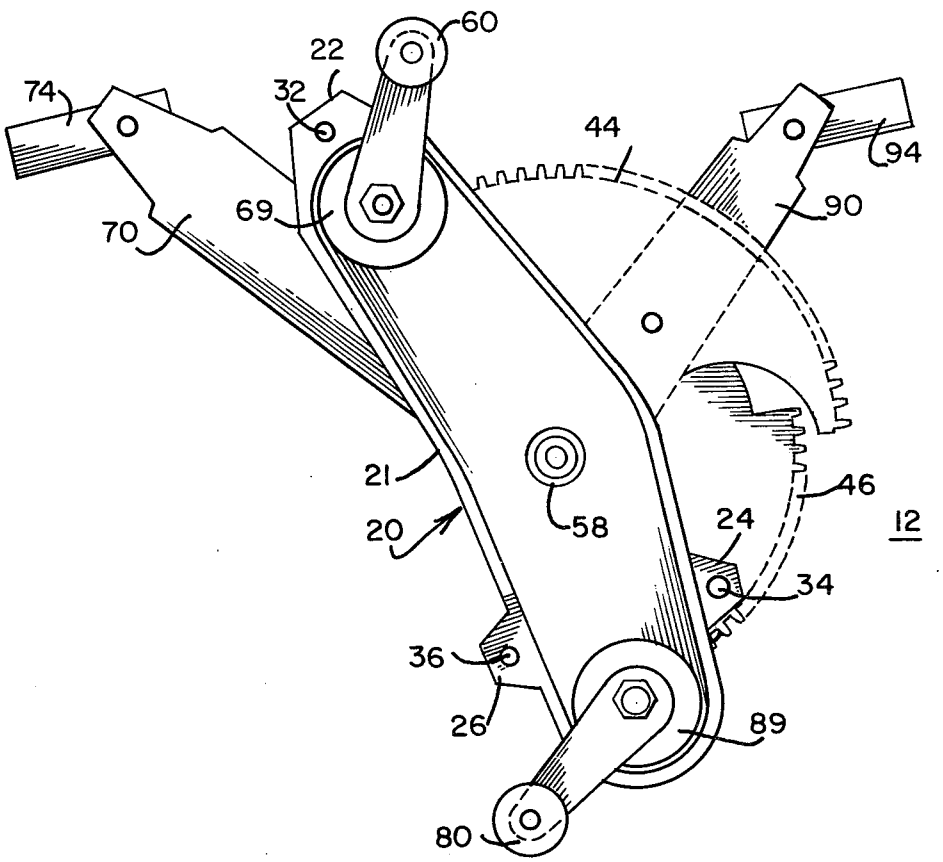
FIG. 2 is a side elevational view of the mechanism of FIG. 1, viewed from the opposite side (the inside of the vehicle side)
Figure 4:
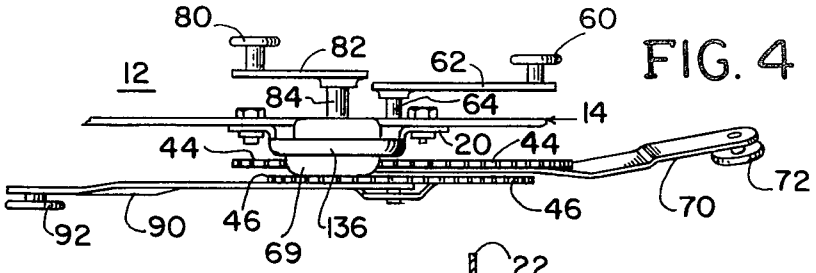
FIG. 4 is a plan view of the mechanism of FIG. 1.

The main window panel operator in the manual version shown herein, is controlled by a crank handle 60 protruding from the vehicle door into the occupants' compartment, as is conventional. The handle 60 has a crank lever 62 parallel to the door panel 14, the lever being affixed at a pivot rod 64 to the pinion gear 54 for joint rotation. The connection of the crank lever 62 to the pinion gear 54 is effected by a pivot pin 64 which is journalled within opening 51 of the curved socket area 66 of the main mounting plate. A suitable enclosing cover 69 may be provided for the pinion gear as shown in FIGS. 2 and 4.

The main window panel sector gear 46 has its toothed periphery 63 in mesh with the pinion gear so that rotation of the pinion gear responsive to rotation of the crank lever causes rotational movement of the sector gear about its central pivot 42. A pinion gear with six or eight gear teeth has been found to operate satisfactorily to control the main window panel.

Also mounted on the central pivot shaft 42 for rotation thereabout is a main window panel operating arm 70. This arm 70 is pinned or riveted at pin 72 to the sector gear 44 so that rotation of the sector gear 44 causes rotational movement of the operating arm 70 through a like angular distance. The arm extends a distance beyond the periphery of the sector gear, and at its outer end, the operating arm 70 has a roller 72 which is mounted within the conventional window panel track 74. The track, as is well-known, is of U-shaped cross section for receiving the roller and transmits the movement of the operating arm into movement of the main window panel 16 in known fashion.

The construction of the vent window panel operator is similar to that described for the main window panel operator and includes a vent window crank handle 80 similar to that previously described for the main window. The operator for vent window panel 18 has a crank lever 82 affixed to the crank handle 80. The crank lever 82 is pivotally supported on a pivot rod 74, the rod being affixed to the vent window pinion 56, for common rotation about pivot opening 52 in the main mounting plate 20 within a raised socket section 86 of plate 20 and within cover 89. The pinion 56 is in mesh with the toothed periphery 83 of the vent window panel sector gear 46. Sector gear 46 is rotatable on the common pivot shaft 42 supported on the main mounting plate 20.

A vent window panel operating arm 90 is also secured for rotation on the central pivot shaft 42. This arm 90 is suitably pinned to the vent window sector gear 46 for common rotational movement with the gear 46. The arm 90 extends beyond the periphery of sector gear 46 a distance and at its outer end, the arm 90 has a roller 92 within a roller track 96 to cause movement of the vent window panel in a manner similar to that noted relative to the main window panel.

In FIG. 2, I show the unitary mechanism of FIG. 1, as it would be viewed from the rear side which is adapted to mount against the door support panel. The main mounting plate 20 is shown with its mounting wings 22, 24 and 26 and rim portion 21, the rim portion being coplanar with the wing section for placement against a flat area on the door support panel. The socket-like portions 66 and 86 provided to cover and enclose the pinion gears are also visible in FIG. 2. These sockets may also contain a one-way clutch mechanism (of any conventional design) to lock the windows and prevent movement of the sector gears due to movement of the operating arms. The use of such one-way clutches for this purpose is well-inown in the art.

Figure 3:
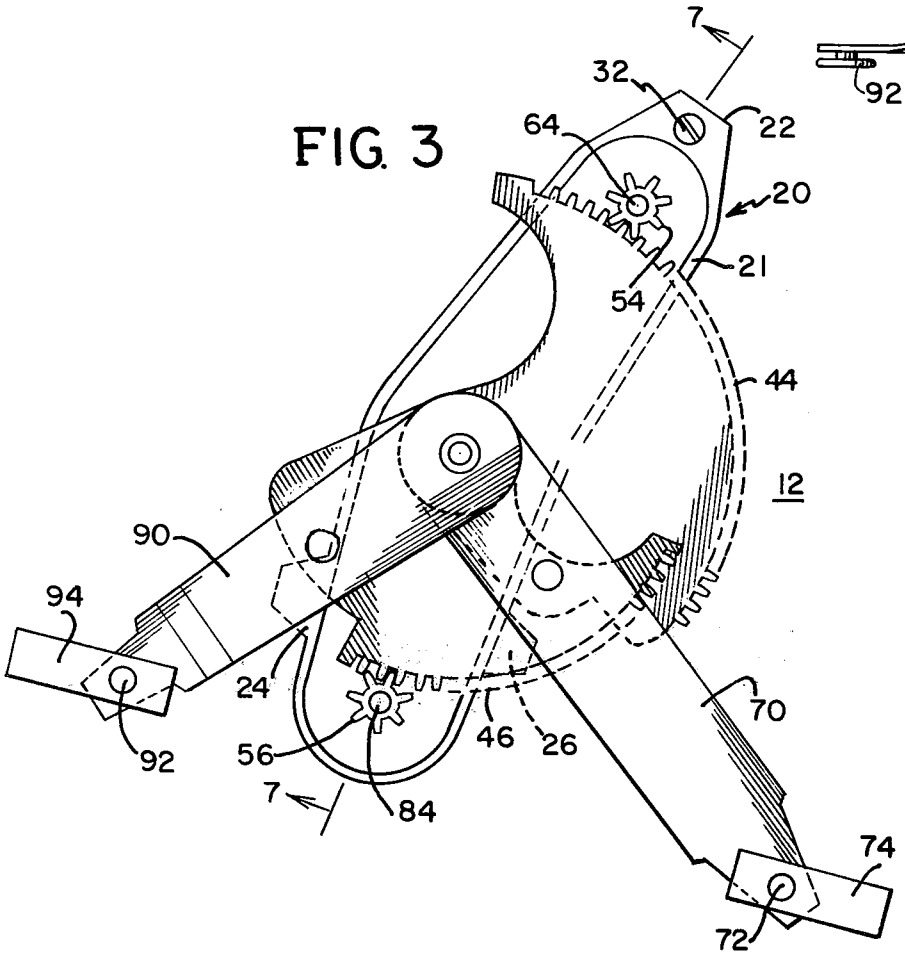
FIG. 3 is a side elevational view of the mechanism of FIG. 1, with the window panels in the fully open position.

In FIG. 1, the window panels are shown in the fully raised position with the respective pinion gears at respective extreme end of the sector gear toothed areas 112 and 122 and with the respective operating arms in their elevated conditions. In FIG. 2, the window panel operators are shown in the raised position of FIG. 1 to maintain the window panels in the closed position. In FIG. 3, I show the position of the mechanism for the fully lowered or open condition of both window panels. In this condition, both operating arms are in their lowermost position with the pinion gears being in mesh with the ends of the sector gears toothed areas opposite the end shown meshed in FIGS. 1 and 2.

In FIG. 5, I show in greater detail the main window panel sector gear 44. The sector gear 44 has a pivot opening 110 about which the gear rotates. The peripheral toothed area 112 is disposed concentrically about pivot opening 110. The toothed area extends angularly for approximately 120° to 130° with limit stop area 114 bordering the toothed area at each end. Angularly external to this toothed area and spaced a radial distance from the pivot opening is an opening 116 for pinning or riveting of the operating arm 70. The operating arm 70 extends along and is supported by the sector gear surface between its common pivotal mounting to the gear at opening 110 and its pinning to the gear at opening 116, the position of the arm 70 being clear of the area of the toothed periphery of the sector gear.

By combining a proper pitch radius for the sector gear 44 with the length of the operating arm 70, a suitable window sealing force of about 100 pounds may be generated for the main window panel. Alternatively, a suitable torsion spring (not shown) may be mounted on central pivot shaft 42 to add to the window sealing force developed and to assist in producing suitable speed of motion. I have found that a main sector gear having a radius of approximately five inches with its toothed area angularly disposed over approximately 120° of periphery may produce approximately 20 inches of window travel by using an operating arm 70 with approximately nine and three-fourths inches of length.

One side edge of the main sector gear 44 is inset curvedly to provide clearance between the sector gear and the operating arm 90 of the vent window panel.

FIG. 6 shows the vent window panel sector gear 56. This sector gear has a slightly smaller radius from its pivot opening 120 to its concentric toothed area 122, the area covering approximately 90° of the gear periphery. At the ends of the toothed area are the limit stop sections 124. Spaced radially from the pivot opening is an opening 126 for pinning, riveting or otherwise securing the vent window operating arm 90 to the sector gear 46 outside the toothed peripheral area of the sector gear. I find that with a radius of approximately four and a fourth inches for the sector gear and employing an operating arm length of approximately seven and a half inches, I can develop about eleven inches of vent window panel travel and produce a sealing force of about thirty-five pounds.

In FIG. 7, I show the main mounting plate 20 in greater detail. The section of FIG. 7 is through the center line of the plate. In this figure, the rim area 21 and one mounting wing 22 are shown in the plane adapted to mount against the door panel. The central section is shown as raised from the rim and includes a central embossed area 132 surrounding the opening 41 for the common pivot shaft 42. The embossed area provides a guide surface for the sector gear 44 for the main window panel, this gear being adjacent the panel.

Similarly an embossed area 134 on the plate 20 provides socket 86 a flatted area for a pinion gear 56 at the lower end of the plate 20. This emboss surrounds the opening 52 in the plate, the opening receptive of the pinion gear pivot pin 84.

At the top end of the plate a similar emboss 136 provides socket 66 and a mounting surface for the main window panel pinion gear 54 about opening 51.

In operation, rotation of the main window panel crank handle 60 rotates its pinion gear 54 and causes rotational movement of the meshed sector gear 44 accordingly. This movement of the sector gear 44 carries with it the operator arm 70 to move the main window panel accordingly. Starting from the fully lowered or open condition three to five turns of the crank will fully raise the main window panel.

Similarly, rotation of the crank handle 80 for the vent window panel causes rotation of the pinion gear 56. Rotation of the pinion gear 56 drives its meshed sector gear accordingly and angularly moves the vent window panel operator arm 90 to raise or lower this window panel dependent on the direction of crank rotation.

Movements of both window operators are independent of one another so that one window panel can be raised, the other lowered or any combination of terminal or intermediate conditions may be produced.

In the mechanism shown, I have provided a single or unitary base plate on which both sector gears and their pinion gears are mounted. Thus, once the proper center distances between the gears have been set during the fabrication and assembly of the mechanisms onto plate 20, the operating relationships of the members have been set in a manner requiring no further adjustments.

The mechanism once assembled, can be mounted on the door inner panel and secured to the window panels. Only the crank mechanisms as shown need be mounted thereafter to place the mechanism in a fully operative condition. In the case of motor-driven apparatus (not shown), the motor or motors would be mounted on the mechanism prior to assembly of the mechanism to the door, and the unitary mechanism would be applied to the door panel.

By providing a common mounting of the sector gears and operating arms on the common pivotal shaft, internal torsional stresses within the mechanism are minimized.

In addition, as mentioned previously, the mechanism can be assembled as a sub-assembly and stocked as such so that the mechanism can be mounted on the automobile door in a simple and economical manner.

While there has been described what is at present thought to be the preferred embodiment of the invention, modifications may be made therein and it is intended to cover in the appended claims all such modifications which fall within the true spirit and scope of the invention.

I claim:

1. A mechanism adapted for controlling the reciprocating movement of a first planarly slidable window panel and a second planarly slidable window panel with each panel independently slidable between fully raised, lowered and intermediate positions independently of one another within a common sliding plane, said mechanism comprising a first rotatable operating arm and means for changing rotational movement of said arm into reciprocal movement of said first panel, a second rotatable arm and means for changing the rotational movement of said second arm into a reciprocal movement of said second second panel, a common pivotal shaft for both said arms, a sector gear secured to each arm, for causing rotation of the respective rotatable arms on rotation of said sector gears, both said sector gears mounted for rotation independently of one another on said common pivotal shaft, and means for driving each sector gear independently of the other sector gear to reciprocate the windows independently of one another, each said driving means including a pinion gear in mesh with a respective one of said sector gears, and a unitary structural plate for mounting said pinion gears and said common pivotal shaft, and wherein said unitary structural plate is configured to secure said entire mechanism to a flat wall, said plate including a central socket area for said pivotal shaft, said wall and opposed sockets spaced from said shaft for said pinion gear mountings.

2. A regulator mechanism for operating a first and a second slidable automotive window panel independently of one another comprising, in combination, first and second window panels independently slidable in a common plane between fully open and fully closed positions, a unitary stationary supporting frame for said mechanism, a common pivot shaft mounted on said supporting frame, a first sector gear rotatably mounted on said common pivot shaft for oscillation through one path between angularly spaced extreme positions about said pivot shaft, a first lever secured to said first sector gear for oscillation therewith and operably connected to said first window panel, a second sector gear rotatably mounted on said pivot shaft for oscillation through a second path between angularly spaced extreme positions, a second lever secured to said second sector gear for oscillation therewith and operably connected to said second window panel, both said levers pivotally mounted for rotation with the respective sector gear independently of one another, a first driver gear mounted on said supporting frame to engage said first sector gear to oscillate said first sector gear and said first lever on rotation of said first driver gear, a second driver gear mounted on said supporting frame to engage the second sector gear for oscillation thereof responsive to rotation of said second driver gear, said driver gears spaced-apart angularly on opposed sides of said common pivot adjacent the extreme sector gear positions to maintain the operative ends of said levers out of interference with one another during movement of said levers and consequent movement of said window panels.

3. A regulator mechanism as claimed in claim 2 wherein said frame comprises a configured sheet metal member including a central raised mounting support for said pivot shaft, and a raised support area for both said driving gears to fix the relative positions of the engaging gears and means on the periphery of said frame for mounting said mechanism on a vehicle door as a unitary assembly.

4. A regulator mechanism adapted to operate first and second slidable automotive window panels, wherein said window panels comprise a first large window and a second smaller window both slidable individually in a common plane between fully raised and fully lowered positions, a rigid, stationary structural member for said mechanism, a common pivotal shaft mounted on said structural member, a first sector gear mounted on said common pivotal shaft for rotary movement through one path between angularly spaced extreme positions about said pivotal shaft, an extension of one predetermined length on said first sector movable responsive to rotary movement of said sector gear for raising and lowering said first window panel on said movement, a second sector gear mounted on said first pivotal shaft for rotary movement through a second path between angularly spaced extreme positions, an extension of another predetermined length on said second sector gear movable responsive to rotary movement of said second sector gear for raising and lowering said second window panel, a first driver gear mounted for rotation on said structural member and rotatable to mesh with teeth on said first sector gear to pivot said first sector gear and its extension lever on rotary motion of said first sector gear by said first driver gear, a second driver gear mounted for rotation on said structural member and rotatable to engage the second sector gear for rotary movement thereof responsive to rotation of said second driver gear, said driver gears spaced from said common pivotal shaft by separate pitch radius distances, each said pitch radius distance and the length of the respective extension determinative of the travel of the respective windows and sealing forces on the respective windows for the raised position, and wherein said pivotal shaft is affixed on said structural member and shafts for both said driver gears are affixed to said support member at opposed ends thereof.

5. In combination, a window panel divided substantially vertically into a small ventilation section and a large visibility section, and a window regulator mechanism for lowering and raising the window panel sections into and out of a window opening, the window regulator mechanism comprising an elongated mounting plate positioned beneath the larger of the two panel sections adjacent the division therebetween with its longitudinal axis extending generally in the same direction as the division line between the panel sections, a first and a second gear sector in superimposed relationship on a pivot shaft journalled in the mounting plate intermediate the ends of the latter, a first regulator arm fixed to the first gear sector and a second regulator arm fixed to the second gear sector, each regulator arm being swingable about the axis of the pivot shaft and being coupled to a respective one of the panel sections for lowering and raising the latter in response to rotation of the gear sector to which it is fixed, and independent first and second drive means located at opposite ends of the mounting plate and coupled to the first and second gear sectors, respectively for rotating the latter to independently lower and raise the window panel sections.

6. A vehicle body structure according to claim 5, in which: the respective gear sectors are rotated in opposite directions about the pivot shaft axis to oppositely swing the regulator arms in respective window panel section lowering or raising directions in response to independent rotation of the first and second drive means in common directions of rotation.

* * * * *